US007086213B2

(12) United States Patent
Stauber

(10) Patent No.: US 7,086,213 B2
(45) Date of Patent: Aug. 8, 2006

(54) STRAPPING DEVICE INCLUDING LOOP FORMING CHANNEL AND LOOP GUIDE

(75) Inventor: Hans-Ulrich Stauber, Grüt (CH)

(73) Assignee: Ferag AG, Hinwil (CH)

( * ) Notice: Subject to any disclaimer, the term of this patent is extended or adjusted under 35 U.S.C. 154(b) by 34 days.

(21) Appl. No.: 10/519,296

(22) PCT Filed: May 22, 2003

(86) PCT No.: PCT/CH03/00325

§ 371 (c)(1),
(2), (4) Date: Dec. 22, 2004

(87) PCT Pub. No.: WO2004/002829

PCT Pub. Date: Jan. 8, 2004

(65) Prior Publication Data

US 2005/0229551 A1 Oct. 20, 2005

(30) Foreign Application Priority Data

Jun. 28, 2002 (CH) ..... 1127/02

(51) Int. Cl.
*B65B 27/08* (2006.01)
*B65B 13/06* (2006.01)

(52) U.S. Cl. ..... 53/589; 53/157; 53/582; 100/1; 100/8; 100/26

(58) Field of Classification Search ..... 53/589, 53/582, 580, 157, 139.6; 100/26, 25, 8, 1
See application file for complete search history.

(56) References Cited

U.S. PATENT DOCUMENTS 4,062,278 A * 12/1977 Cheung ..... 53/582
4,077,313 A * 3/1978 Lems et al. ..... 100/26
4,079,667 A * 3/1978 Lems et al. ..... 100/26
4,378,262 A * 3/1983 Annis, Jr. ..... 53/582
RE31,353 E * 8/1983 Cheung ..... 156/580
5,078,057 A * 1/1992 Pearson ..... 100/25
5,373,686 A * 12/1994 Lang et al. ..... 53/589
5,842,327 A * 12/1998 Schwede ..... 53/589
6,901,727 B1 * 6/2005 Muller ..... 53/589
2002/0083689 A1 * 7/2002 Muller ..... 53/589
2005/0139092 A1 * 6/2005 Schuttler et al. ..... 100/26

FOREIGN PATENT DOCUMENTS

DE 42 30 730 A1 3/1994
EP 0 905 025 A1 3/1999
EP 1 207 107 A1 5/2002

* cited by examiner

*Primary Examiner*—Stephen F. Gerrity
(74) *Attorney, Agent, or Firm*—Rankin, Hill, Porter & Clark LLP

(57) ABSTRACT

A strapping installation, which serves in particular for longitudinally strapping stacks of printed products such as newspapers or periodicals with a strap (6), includes a strapping position with a bearing surface (2) and a device for positioning the objects to be strapped (1) in the strapping position and a device for discharging the strapped objects. The strapping position includes a fastening region (3), situated below the bearing surface (2) and equipped for feeding the strap (6) into a loop channel (4), securing one end of the strap loop (7), retracting the strap (6) from the loop channel (4), and fastening and severing a completed strapping. The installation also includes a loop guide (10), which is stationary during strapping, which rises from the bearing surface (2) inside of the loop channel (4) and beside the strapping position, and which arches across or towards the strapping position.

18 Claims, 5 Drawing Sheets

STRAPPING DEVICE INCLUDING LOOP FORMING CHANNEL AND LOOP GUIDE

BACKGROUND OF THE INVENTION

1. Field of the Invention

The invention lies in the field of the packaging technology and concerns a strapping installation according to the generic part of the independent claim. The strapping installation serves the purpose of strapping objects, in particular of essentially parallelepipedic objects, e.g. of stacks of printed products such as newspapers, periodicals, etc. The installation particularly serves the purpose of essentially simultaneous strapping in two directions at a right angle to each other (cross-strapping). The strap used for strapping is tape-like (strapping tape), or string- or wire-like, and it is preferably stiff enough to be moved by pushing.

2. Background of the Invention

For automatic strapping, objects to be strapped are conveyed in succession on a bearing surface to a strapping position where each one is positioned and strapped, and from where they are removed again in succession. The strap is supplied to the strapping position, e.g. from a supply reel located below the bearing surface. Usually the strap is formed into a loop which is larger than the strapping to be achieved and which has a position from where it can be moved to encircle the object. By retracting the strap the loop is then placed around the object and tightened and usually it is then fastened beneath the object and severed from further supplied strap.

Preparing a loop for longitudinal strapping (strapping direction parallel to the conveying direction) is less simple than preparing a loop for transverse strapping (strapping direction transverse to the conveying direction), because in its final position, the longitudinal loop obstructs the supply route of the object to be strapped. Therefore, the loop cannot take up this position before the object is positioned in the strapping position. State of the art technology includes various methods for establishing a longitudinal loop such that the object to be strapped can still be supplied to the strapping position after, or preferably during loop preparation.

One such method is described in the publication EP-1207107, which proposes, for loop preparation, a groove-shaped loop channel integrated in the bearing surface. Thus the loop is prepared in a horizontal plane below the bearing surface where it does not obstruct conveyance of the object to be strapped. As soon as the object is positioned in the strapping position, the loop is lifted from the loop channel by a loop moving means and is brought into a vertical position in which it encircles the object to be strapped. From this position, the loop is placed on the object and tightened by strap retraction. The loop moving means e.g. comprises grippers positioned in the area of the groove-shaped channel prior to the loop motion and being moved along suitable tracks together with the loop for bringing the latter to its final position. As the grippers have a small weight they can be accelerated fast.

A further method is described in the publication U.S. Pat. No. 5,078,057 (or DE-4100276, Signode Corp.). This publication discloses essentially simultaneous longitudinal and transverse strapping (cross strapping). A loop channel is designated to each strapping, wherein the longitudinal channel rises arch-like above the bearing surface on one side of the object to be strapped. The upper part of the arch vaults above the strapping position. The channel does not obstruct the supply route to the strapping position and yet it extends partly above the object positioned for strapping. Such loop channel design makes it necessary, that the loop channel, at least for a tape-like strap, is not only bent but also twisted, which renders the loop channel to be a rather complicated and costly part of machinery.

SUMMARY OF THE INVENTION

The present invention creates a strapping installation for strapping objects using a previously prepared strap loop which installation is to be simple and involving a minimum of moving parts and which installation is still to be able to be operated with short cycle times. The installation is in particular suitable for longitudinal strapping but including further simple equipment is to be suitable for essentially simultaneous cross strapping.

In the same way as the strapping installations according to EP-1207107 and U.S. Pat. No. 5,078,057, the strapping installation according to the invention comprises in its strapping position a fastening region which is located below the bearing surface and in which a loop channel begins and ends. For preparing the loop, the strap is supplied to the fastening region or to the beginning of the loop channel respectively and moved into the channel. The loose end of the loop exiting from the loop channel end is secured in the fastening region. Also in the fastening region, the strap is retracted from the loop channel for reducing the loop size and for tightening the loop. Furthermore, the tightened strapping is fastened and severed from further supplied strap. From the fastening region, the loop channel which is essentially designed as a groove in the bearing surface, extends in two opposite directions from the strapping position and runs around one side of the strapping position (i.e. the largest plan view of an object to be strapped). The fastening region lies e.g. centrally beneath an object to be strapped, and for longitudinal strapping, the beginning and end of the loop channel extend parallel to the conveying direction.

Other than the strapping installation according to EP-1207107, the strapping installation according to the invention comprises a stationary loop guide (stationary at least during strapping) which rises from the bearing surface within the area encircled by the loop channel and on one side of an object positioned in the strapping position, and which arches, depending on the supply direction, across or towards the strapping position such that it does not obstruct supply of the object to be strapped to the strapping position. This loop guide is arranged and dimensioned such that the loop, prepared in the loop channel and with the strap end being secured in the fastening region, on strap retraction, is lifted from the channel and slides upwards along the loop guide until it drops from the loop guide above the object positioned in the strapping position. By further strap retraction, the loop is then drawn and tightened around the object. While the loop rises from the loop channel and along the loop guide and while the loop drops from the guide end and is placed and tightened around the object to be strapped, it is continuously reduced in size by strap retraction.

The loop guide is therefore arranged and dimensioned to the effect that the length of a loop, positioned in the loop channel below the object to be strapped and held at an increasing height above the bearing surface by the loop guide, is the smaller, the higher it rises above the bearing surface.

Using the installation according to the invention, longitudinal strapping is performed in the following manner: A strap loop is prepared in the groove-shaped loop channel, e.g. by feeding a loose strap end into the channel from the fastening region, and back to the fastening region, where the strap end is secured. For straps being less rigid, means for pulling the strap into the channel may be provided.

The object to be strapped is conveyed to, and positioned in the strapping position, advantageously simultaneously with the loop preparation. As soon as the loop is prepared in the loop channel (loose strap end secured in the fastening region), and the object to be strapped is positioned in the strapping position, the strap is retracted in a direction opposite to the feeding direction, i.e. the loop is reduced in size or length. Thus at the point where the channel does not run beneath the object to be strapped, the loop rises along the loop guide from the channel, until it drops from the upper end of the loop guide and encircles the positioned object. Then, the loop is tightened, fastened and severed from further supplied strap in a per se known manner.

If applicable, and in particular if the object to be strapped is small compared to other objects to be strapped, strap retraction may be started already before the object is positioned right in the strapping position.

The main advantage of the installation according to the invention lies in the fact that the loop channel is of a significantly simpler shape than the one according to publication U.S. Pat. No. 5,078,057, and yet there is no need for special mobile parts as disclosed in publication EP-1207107. The means for strap retraction, which is to be provided in any case for tightening the loop around the object to be strapped, assumes (in cooperation with the loop guide) the additional function of positioning the loop around the object.

If the strap is tape-like, i.e. it does not, or not easily bend in the plane of its width, the equipment of the fastening region and the loop channel are to be adjusted to each other to the effect that the width of the tape in the groove-shaped channel is vertical to the bearing surface, at least there, where the channel is curved. This can be achieved essentially in three ways. Either the fastening region is equipped in a per se known manner to holding the strapping tape with its width always being parallel to the bearing surface, and the loop channel comprises a 90° twist, preferably immediately before and after the fastening region. Or the fastening region comprises a rotary tape support, aligning the width of the tape vertical to the bearing surface while the loop is prepared, and reverting to a position aligning the width of the tape parallel to the bearing surface while the tape is retracted. In this case the loop channel does not need to be twisted. In the third option, the fastening region is equipped to hold the strapping tape with its width always perpendicular to the bearing surface, and the tape is advantageously also supplied with such orientation. For fastening the loop, it is held in this position and does not lie flat around the object until the latter has been discharged from the strapping position.

BRIEF DESCRIPTION OF THE DRAWINGS

Exemplary embodiments of the strapping installation according to the invention are described in detail in connection with the following figures, wherein:

(FIG. 3A: closed; FIG. 3B: open);

(FIG. 8: viewed in parallel to the discharge direction; FIG. 9: top view).

DETAILED DESCRIPTION OF THE PREFERRED EMBODIMENT

Figure 1:
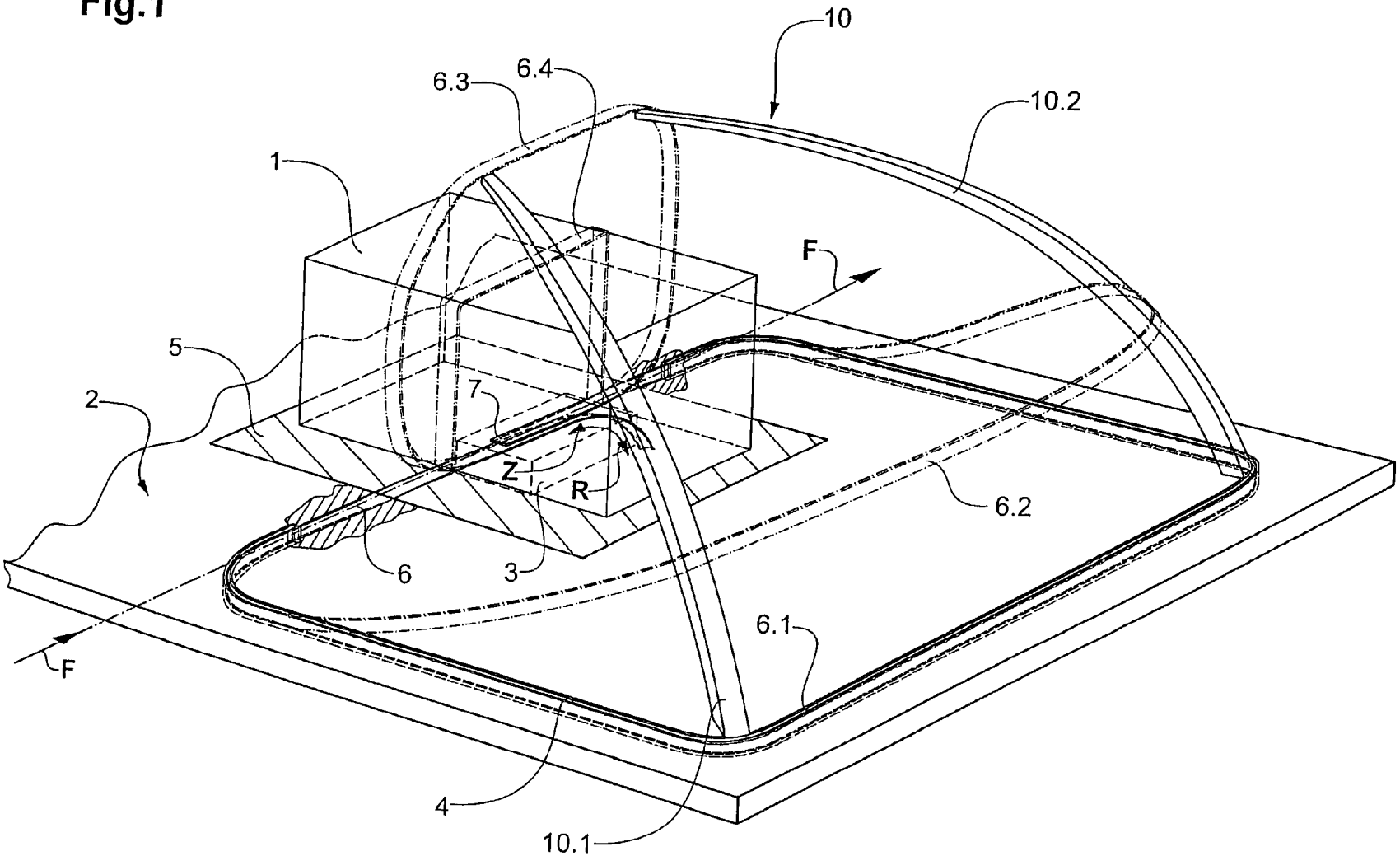
FIG. 1 is a three-dimensional illustration of the strapping position of an exemplary embodiment of the strapping installation according to the invention.

FIG. 1 shows the strapping position of an exemplary embodiment of the strapping installation according to the invention. This strapping position is equipped for central longitudinal strapping of an object 1, which is conveyed in an essentially horizontal conveying direction F on a bearing surface 2 into the strapping position, and, when strapped, is conveyed away again in the conveying direction F. The fastening region 3 is located in the strapping position in a suitable opening of the bearing surface 2 below the level of the bearing surface. From the fastening region 3, a groove-shaped loop channel 4, set in the bearing surface 2, extends parallel to the conveying direction F in both directions, and closes on one side around the plan view 5 of a maximum sized object to be strapped. In a per se known manner and not illustrated in detail, the fastening region 3 is equipped for strap supply (strap 6 having the shape of a tape) in a strap supply direction Z into the loop channel 4, for securing the loose strap end 7, for retracting the strap in a retracting direction R (opposite to the supply direction Z), for tighten the strap around the object to be strapped 1, for fasten the loop around the object, and for severing the loop from further supplied strap.

The strapping position further comprises a loop guide 10, shown here in the shape of two slide rails 10.1 and 10.2, rising from the bearing surface 2 inside of the loop channel 4 and on one side of the strapping position, and arching across the strapping position. These slide rails 10.1 and 10.2 guide the strap loop prepared in the loop channel 4 upwards when the loop is reduced in size by strap retraction (direction R).

The strap loop is illustrated in four consecutive positions. The loop in its starting position, in which it lies in the loop channel 4, is designated with 6.1 and shown in drawn-out lines. Loops 6.2 to 6.4 shown in chain lines are in relation to loop 6.1, increasingly shortened by strap retraction in direction R. Through shortening, loop 6.2 has risen from the loop channel 4 and along the slide rails 10.1 und 10.2. By further shortening, loop 6.3 has reached the end of the slide rails 10.1 und 10.2 and, by further shortening, it will detach itself from the rail ends and encircle the object to be strapped 1, as indicated by loop 6.4.

Figure 8:
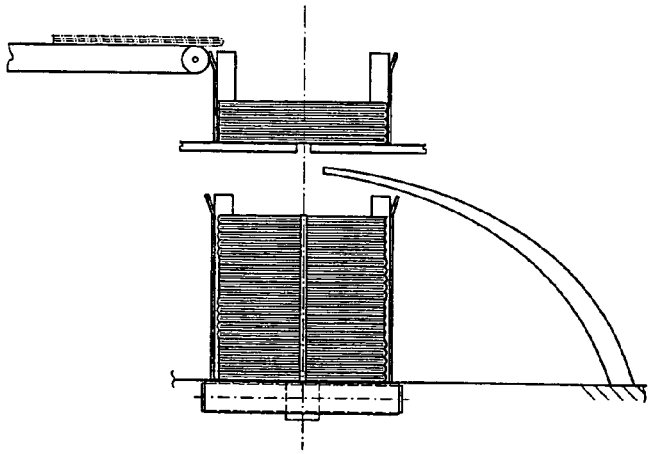
FIGS. 8 and 9 show a further exemplary embodiment of the strapping installation according to the invention

The strapping position shown in FIG. 1 is equipped for longitudinal strapping if the conveying direction is F as illustrated. It is clearly evident from the FIG. 1 that the conveying direction can also proceed transverse to the illustrated direction F, in which case the strapping position is equipped for transverse strapping. It is further evident from FIG. 1 that an object to be strapped can also be brought into the strapping position from above (supply direction not corresponding with the conveying direction F, but at a right angle to it). Such supply asks for corresponding arrangement of loop channel 4 and of the slide rails 10.1 und 10.2, which is shown in FIGS. 8 und 9.

The loop guide 10 may comprise, instead of slide rails 10.1 und 10.2 as shown in FIG. 1, more than two slide rails or it can be designed as a single flat element. In either case, the loop guide 10 rises from the bearing surface 2 inside of the loop channel 4 and to the one side of the strapping position and arches across or towards the strapping position so that its upper end is positioned e.g. above the fastening region 3. The external side of the loop guide 10 is equipped for a sliding strap motion thereon.

Figure 2:
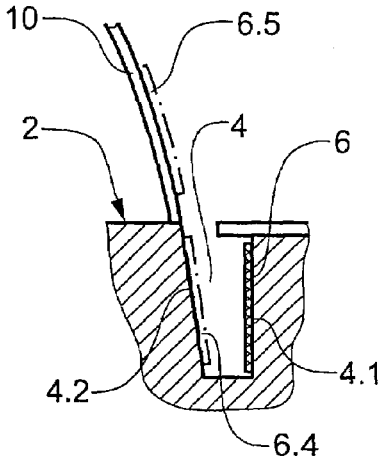
FIG. 2 is a cross section through an exemplary groove-shaped loop channel for the strapping installation according to the invention.

FIG. 2 is a cross section through an exemplary embodiment of the groove-shaped loop channel 4 arranged in the bearing surface 2 of the strapping installation according to the invention, as well as the bottom part of a loop guide 10. The inward side of the loop (side of the loop guide 10) is on the left of FIG. 2, the outward loop side on the right. A relatively stiff tape used as strap 6 bears against the outer wall 4.1 of the channel on being inserted into the loop channel 4, at least where the channel curves. As soon as the tape is retracted and the loop reduced in size, the tape rests against the inner wall 4.2 of the channel (position 6.4 of the strap) and then rises from the channel and is guided through its further ascent (position 6.5 of the strap) by the loop guide 10. Therein, it is advantageous to design the inner wall 4.2 of the loop channel 4 is sloping towards the loop guide 10 and to ensure that the loop guide's outer side is flush with this sloping inner channel wall 4.2, as is shown in FIG. 2.

FIGS. 3A and 3B show, again in cross section, a further exemplary loop channel 4, which can be closed (FIG. 3A) and opened (FIG. 3B) by a displaceable cover element 12. In its closed position the loop channel enables a smooth passing of the object to be strapped.

Figure 3A:
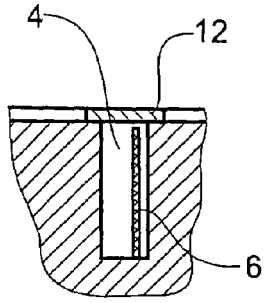
FIGS. 3A and 3B show a further example of a groove-shaped loop channel for the strapping installation according to the invention
Figure 3B:
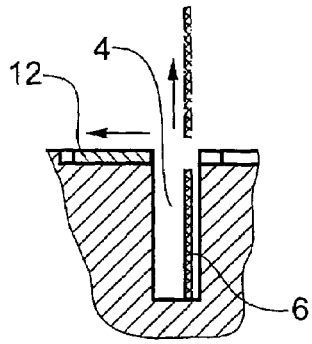

The loop channel 4 according to FIG. 1 may be designed as shown in FIG. 2 where it is curved, and as shown in FIGS. 3A and 3B where it its straight, particularly where it runs at a right angle to the conveying direction.

Figure 4A:
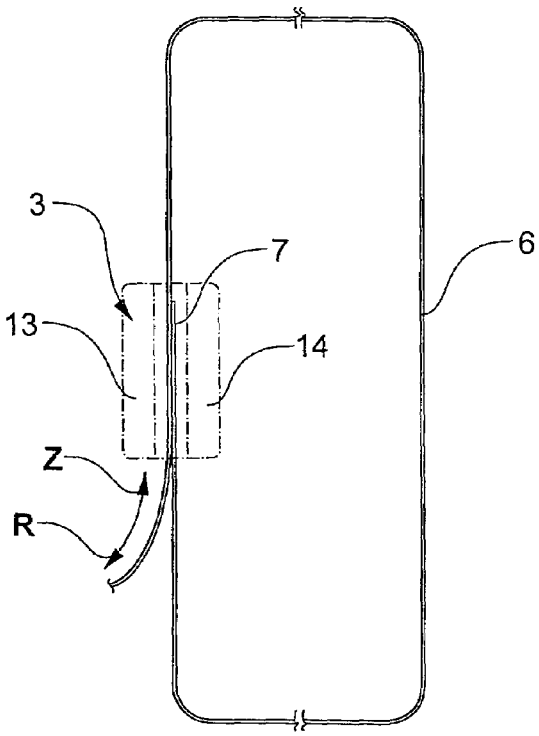
FIGS. 4A and 4B show two embodiments of the route of a strap through the fastening region and in the groove-shaped loop channel of the strapping installation according to the invention.
Figure 4B:
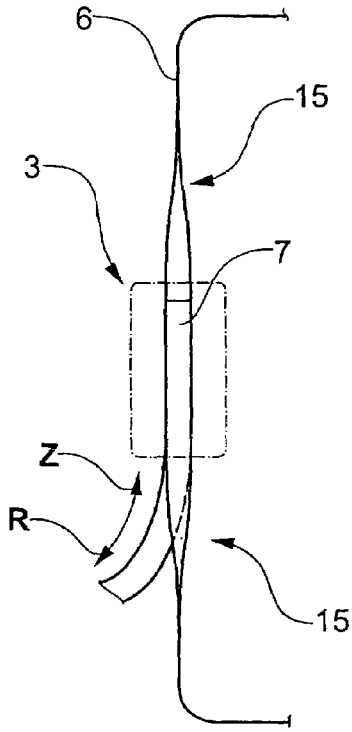

FIGS. 4A and 4B show in top view of the bearing surface, two versions of how a tape-like strap 6 can be arranged in the loop channel and the fastening region. Each version shows a tape loop and a very schematic fastening region 3, from where the tape 6 is fed into the loop channel (direction Z), where the loose tape end 7 is secured, and from where the tape 6 is retracted from the loop channel (direction R). The loop channel itself is not shown.

According to FIG. 4A the tape-like strap 6 is arranged with its width perpendicular to the bearing surface along the entire length of the loop, i.e. the loop channel does not comprise any twists. For preventing the tape itself from twisting, the fastening region may be equipped for rotating the tape while the loop moves from the loop channel to its position around the object to be strapped. For this purpose, the fastening region is equipped with tape holding means being able to be rotated by a minimum of 90°. The tape holding means comprises e.g. a welding head 13 and a counter-bearing element 14, between which the loose strap end 7 and the loop section closing the loop are clamped while the loop is tightened and fastened. During loop preparation, the tape 6 is held in the position shown in FIG. 4A (width of the tape vertical to the bearing surface). On loop shortening and loop movement (tape retraction), the welding head 13 and the counter bearing element 14 are jointly revolved until the width of the strap is aligned parallel to the bearing surface. In this position the loop is fastened by welding.

Rotation of the tape holding means may be active or passive depending on the stiffness of the tape. The rotating holding means advantageously comprises elastic resetting means, reverting the holding means to its starting position as soon as the strapping tape is removed from it.

If the tape to be used is relatively easily pliable, there is no need for the rotating tape holding means as described above. In such a case, the tape is held in the fastening region 3 with its width always vertical to the bearing surface. Thus the tape becomes increasingly twisted during loop movement, and remains twisted also while the loop is tightened around the object and while the loop is fastened. The tape does not untwist until it is released from the tape holding means after completion of the strapping procedure.

FIG. 4B shows a fastening region 3 equipped for holding the tape 6 with its width parallel to the bearing surface. In this case, it is necessary to design the loop channel twisted by 90°, advantageously in each area 15 immediately adjoining the fastening region 3.

Figure 5:
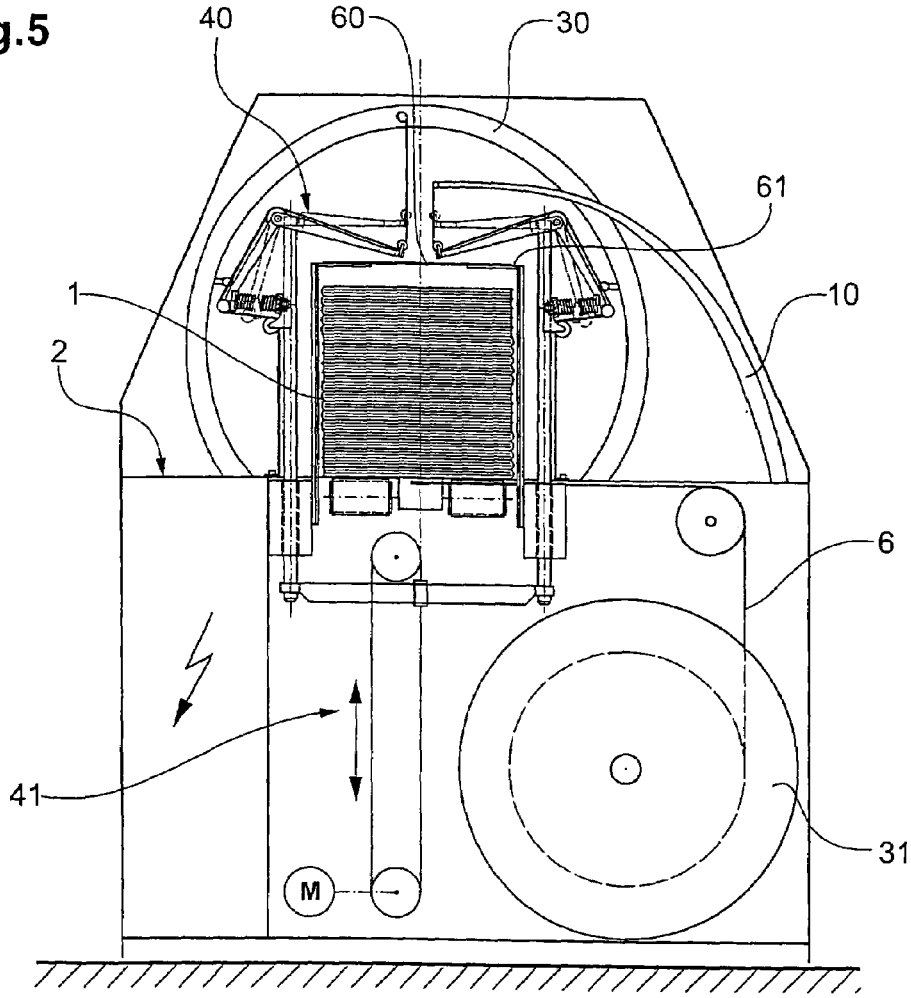
FIGS. 5 and 6 are a side view (FIG. 5) and a top view (FIG. 6) of a further exemplary embodiment of the strapping installation according to the invention, which is equipped for cross-strapping.
Figure 6:
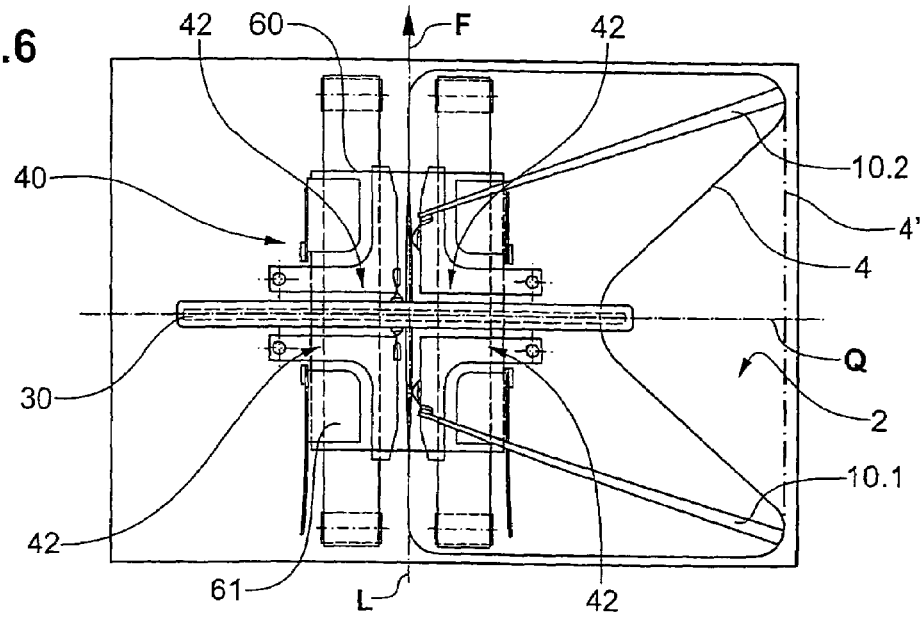

FIGS. 5 and 6 show an exemplary embodiment of the installation according to the invention viewed from the side in conveying direction (FIG. 5) and the bearing surface 2 viewed from the top (FIG. 6). The installation is equipped for cross-strapping, the longitudinal strapping being performed as described in FIG. 1. For the transverse strapping, a per se known stationary loop channel 30 is provided, which loop channel bends around the strapping position in a plane perpendicular to the conveying direction F (transverse strapping plane Q). The object to be strapped is e.g. a stack of newspapers, periodicals, or other flat objects. The strap 6 is drawn from supply reels 31, one each for the longitudinal and for the transverse strapping. With one of the two supplies being appropriately bent and twisted (not illustrated), it is possible to arrange the two supply reels 31 coaxially, as illustrated, and thereby save space.

The installation further comprises pressing means 40 for compressing the objects to be strapped 1 before and during strapping, and drive means 41 for driving the pressing means. In addition to their pressing function, the pressing means 40 are equipped for further functions and are described in more detail in connection with FIG. 7.

The installation shown in the FIGS. 5 and 6 is equipped for transverse strapping subsequent to following longitudinal strapping, wherein both strapping procedures may, at least to a limited extent, also overlap in time. For this reason, the loop channel 30 for transverse strapping extends on the outside of the course of the longitudinal loop and stretches uninterrupted across the strapping position. The loop guides (slide rails 10.1 and 10.2) end below the loop channel 30 for transverse strapping, which rises from the bearing surface on the outside of the groove-shaped loop channel 4 for longitudinal strapping. To achieve the necessary loop lengths for both strappings, the groove-shaped loop channel 4 may comprise concave as well as convex curves, as shown in FIG. 6. If the installation is equipped for longitudinal strapping only, the concave bend is not necessary (channel course 4', illustrated by chain line).

Figure 7:
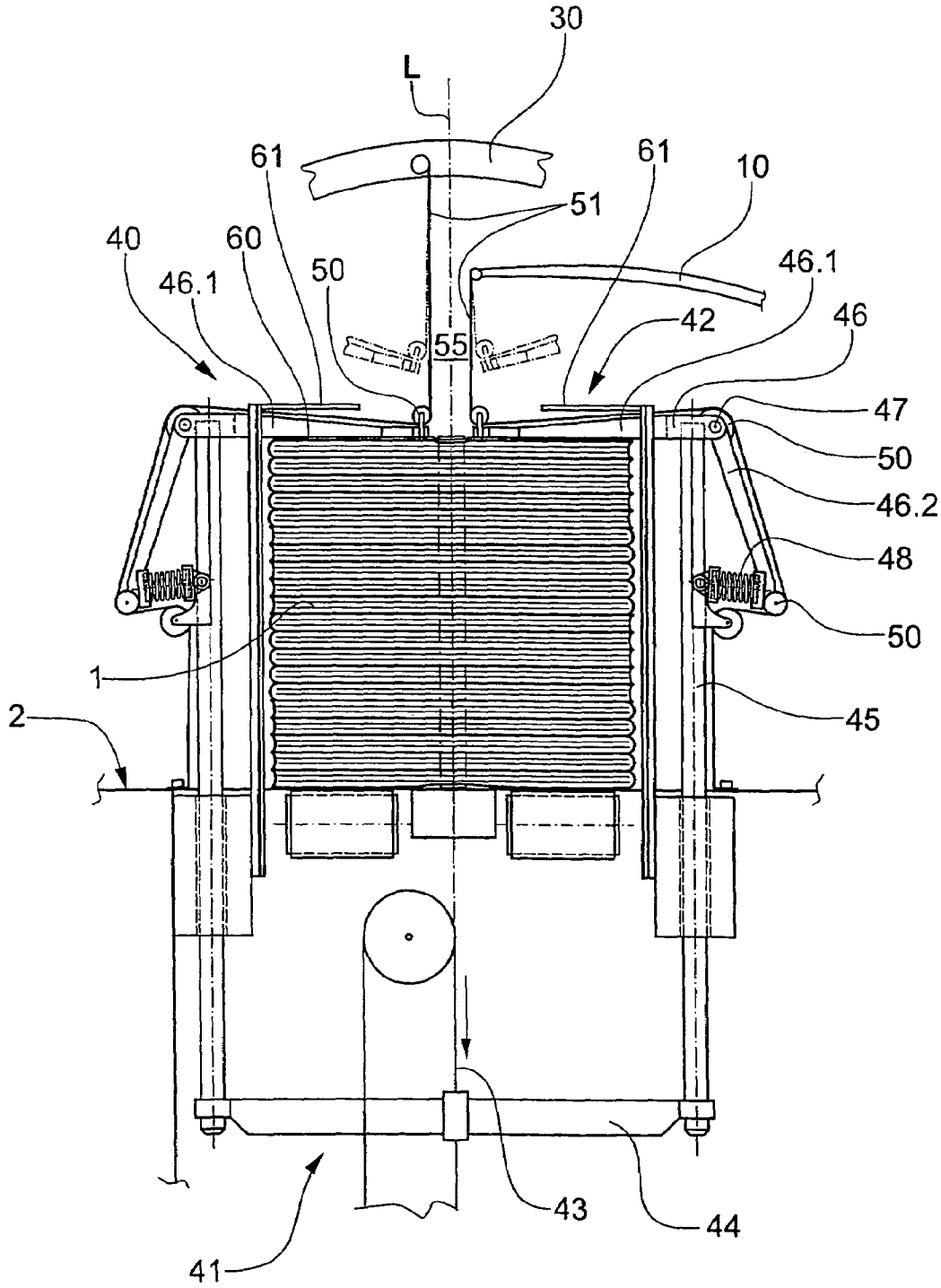
FIG. 7 shows pressing means and further means for strap guidance to be used for longitudinal strapping in the strapping installation according to FIGS. 5 and 6 (side view, larger scale than FIGS. 5 and 6)

FIG. 7 is a side view of the strapping position the same as FIG. 5 but in more detail, and it shows in particular the pressing means 40 of the installation according to FIGS. 5 and 6. As evident from FIG. 6, the pressing means 40 comprises four pressing elements 42 designed and arranged as mirror images of each other in relation to the strapping planes (longitudinal strapping plane L, transverse strapping plane Q). A strapping position equipped for just one strapping (longitudinal or transverse) is advantageously provided with one pair of pressing elements only.

The pressing elements 42 are arranged to be lowered on to the object 1 to be strapped by a common drive 41. The drive 41 is e.g. a chain hoist 43 situated beneath the bearing surface 2 and further comprising crossbeams 44 attached to the chain and carrying a vertical support 45 for each pressing element 42, the supports being arranged beside the strapping position. The pressing elements 42 may be designed as simple pressing plates arranged stationary in relation to the vertical supports 45. Advantageously however, as illustrated in FIG. 7, the pressing elements are designed as angular knee levers 46 arranged to pivot around axis 47 at the upper ends of the vertical supports 45. Each knee lever comprises a pressing part 46.1 extending across the strapping position, and a part 46.2 extending beside the strapping position. Knee lever part 46.2 is biased away from the vertical support 45, e.g. by a spring 48, such that the pressing part 46.1 points downwards from axis 47 as long as the spring 48 is not tensioned.

When the object 1 to be strapped is conveyed into the strapping position, the crossbars 44, and thus also the vertical supports 45 and the knee levers 46, are in an uppermost position. The uppermost position of the knee lever is indicated by chain line in FIG. 7. As soon as the object to be strapped is positioned in the strapping position, the pressing elements 42 are lowered. The ends of the pressing parts 46.1 first touch upon the object to be strapped, and are then pressed into a horizontal position by the springs 48 being compressed during further lowering. Once sufficient pressing force is reached, the actual strapping procedure can begin.

At the same time, the pressing elements 42 may also assume the function of guiding the strap loop when released from the loop guide 10. To this end, the knee levers 46 comprise freely rotatable rollers arranged at the ends of the knee lever parts 46.1 and 46.2, and possibly also in between these ends. The rollers hold a guide tape 51, both ends of which are fastened in a fixed position to stationary parts of the installation. At least one such guide tape 51 is allocated to each one of the four pressing elements 42. The guide tapes 51 extend on one side of the longitudinal strapping plane L from the transverse loop channel 30 and on the other side of the longitudinal strapping plane L from the end of the loop guide 10 and they extend further to the end of the pressing knee lever part 46.1, from there to the end of the lateral knee lever part 46.2, and from there towards the bearing surface. If need be, the guide tapes 51 may be held slightly taut by suitable means which are not shown in FIG. 7.

As evident from FIG. 7, the uppermost parts of the guide tapes 51 form a guiding channel 55 being parallel to the longitudinal strapping plane L and open above the loop guide 10. The strap loop for longitudinal strapping is guided in this channel when moving from the end of the loop guide 10 to its position around the object 1 to be strapped.

FIGS. 5 to 7 also show means for positioning, prior to strapping, a cover sheet 60 on the object to be strapped. This means consists of four essentially stationary sheet supports 61 (for single strapping two sheet supports) which are arranged above the strapping position, again mirroring each other in relation to the two strapping planes L and Q. The height of the sheet supports 61 above the bearing surface 2 is such that even the highest object to be strapped can be conveyed beneath them into the strapping position without being compressed.

In synchronism with successive strapping procedures, the cover sheets 60 are supplied to the sheet supports e.g. in a direction similar to the conveying direction and they are positioned on the sheet supports e.g. from above. Each cover sheet positioned on the sheet supports is then bent downwards by the leading ends of the pressing knee lever parts 46.1 and thus drawn from the sheet supports 61 and positioned on and pressed against the object 1 to be strapped.

Figure 9:
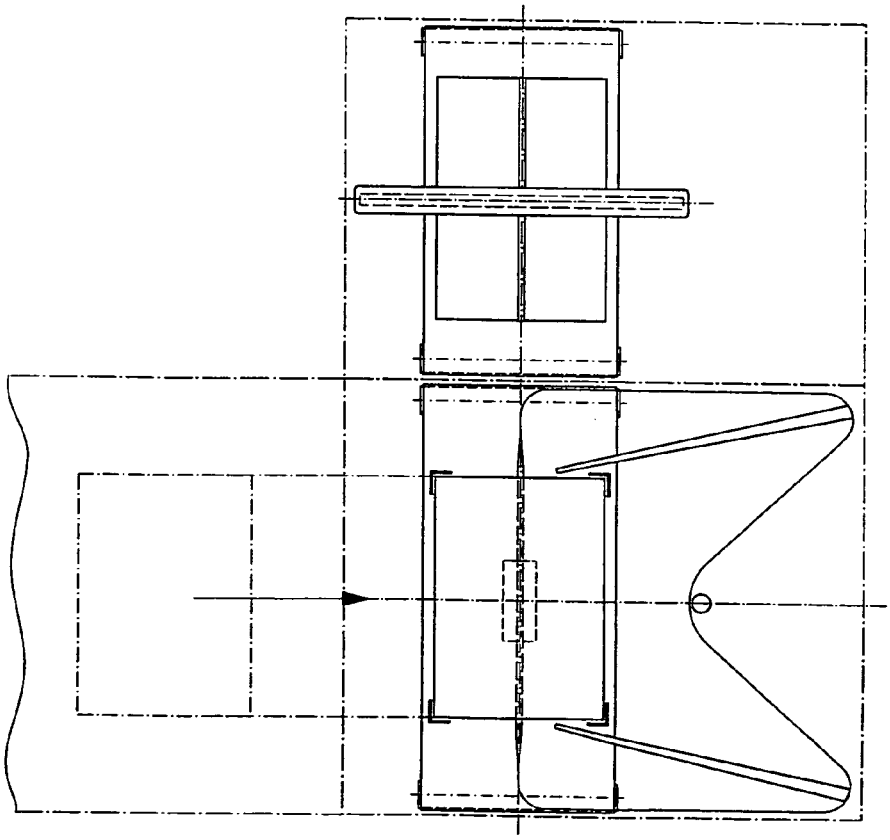

FIGS. 8 and 9 show a further exemplary embodiment of the installation according to the invention. This installation differs from the installations of the previous Figs. in that the conveying direction F in parallel to the bearing surface 2 is only the direction in which the strapped objects 1 are discharged from the strapping position, while the object 1 to be strapped is brought into the strapping position from above, i.e. in a direction (supply direction F') essentially vertical to the bearing surface 2 and to the conveying direction F. This merely requires that the two slide rails 10.1 and 10.2 (or different loop guide), do not reach across the strapping position but arch merely towards the strapping position, allowing unobstructed access from above to the strapping position. This is clearly evident from FIG. 9.

The object 1, strapped in the installation according to FIGS. 8 and 9, is e.g. a stack or cross-stack of flat objects, formed in the strapping position e.g. by supplying stack sections 1.1 from above (supply direction F'). To this end the strapping position is e.g. equipped with corner guides 70 designed to be lowered, at least at the exit side through which the strapped stack is discharged. As shown in FIG. 8, the stack sections can be formed directly above the strapping position by stacking sections of an imbricated supply stream.

If the stacks or stack sections are supplied from above, strapping aided by the loop guide may be a longitudinal or a transverse strapping (in relation to the conveying or discharge direction F). A second strapping, performed simultaneously at least in part (cross-strapping) is not possible, at least not with the aid of a further loop channel as suggested for the transverse strapping in FIGS. 5 and 6 (no access from above). Cross-strapping can be achieved, however, in an additional strapping position 71 (equipped for transverse strapping) which follows the strapping position according to the invention (equipped for longitudinal strapping) in conveying direction F. In this case, the additional strapping position is e.g. equipped with an additional loop channel 30 extending in an essentially vertical plane at right angles to the conveying direction F.

For the embodiment of the installation according to the invention as illustrated in FIGS. 8 and 9, pressing elements and elements for supplying cover sheets, as illustrated in FIGS. 6 and 7, are to be designed in such a way (e.g. laterally displaceable) that they do not obstruct supply of the object to be strapped from above.

The invention claimed is:

1. A strapping installation for strapping objects (1) using a strap (6), the installation comprising:

a strapping position with a bearing surface (2), means for positioning the objects to be strapped in the strapping position, and means for removing the strapped objects from the strapping position in a conveying direction (F) oriented essentially parallel to the bearing surface (2), a fastening region (3) located in the strapping position and equipped for supplying the strap (6) into a loop channel (4), securing a loop end (7), retracting the strap (6) from the loop channel (4), and fastening and severing a completed strapping, wherein the loop channel (4) extends from either side of the fastening region (3) in the shape of a groove in the bearing surface (2), and a loop guide (10), said loop guide being stationary during a strapping procedure, said loop guide rises from the bearing surface (2) inside of the loop channel (4) and on one side of the strapping position and arches across or towards the strapping position such that the loop guide does not obstruct positioning of the objects to be strapped (1) in the strapping position and such that a strap loop (6.2) slides on an outer surface of the loop guide (10), and wherein the strap loop (6.2) being supported and guided by beginning and end of the loop channel (4) and by the loop guide (10) is shorter the higher the strap loop rises on the loop guide (10).

2. The strapping installation according to claim 1, wherein the means for positioning the object (1) to be strapped in the strapping position is equipped for supply from above towards the strapping position or essentially in the conveying direction (F), and wherein the loop guide (10) arches towards the strapping position.

3. The strapping installation according to claim 1, wherein the means for positioning the object (1) to be strapped in the strapping position is equipped for supply essentially in the conveying direction (F) and wherein the loop guide (10) arches across the strapping position.

4. The strapping installation according to claim 1, wherein, for longitudinal strapping, a beginning and an end of the groove-shaped loop channel (4) is aligned parallel to the conveying direction (F), and the installation is further equipped for transverse strapping in the strapping position or in an additional strapping position following the strapping position in the conveying direction (F).

5. The strapping installation according to claim 4, further comprising a further loop channel (30) extending at a right angle to the conveying direction (F).

6. The strapping installation according to claim 5, wherein an element rising from an bearing surface (2) outside of the groove-shaped loop channel is the further loop channel (30), which extends across the strapping position above the loop guide (10).

7. The strapping installation according to claim 1, wherein the loop guide (10) comprises at least two slide rails (10.1, 10.2).

8. The strapping installation according to claim 7, wherein the groove-shaped loop channel (4) comprises a concave bend between the guide rails (10.1 and 10.2) and wherein, in an area of the concave bend of the groove-shaped loop channel (4), an element rising from the bearing surface (2) is arranged on the outside of the loop channel (4).

9. The strapping installation according to claim 8, wherein the element rising from the bearing surface (2) outside of the groove-shaped loop channel is the further loop channel (30), which extends across the strapping position above the loop guide (10).

10. The strapping installation according to claim 1, wherein, at least in the area where the loop guide (10) rises from the bearing surface, the groove-shaped loop channel (4) comprises an inner wall (4.2) slanting towards the bearing surface (2).

11. The strapping installation according to claim 1, wherein at least part of the groove-shaped loop channel (4) is closeable.

12. The strapping installation according to claim 1, wherein the fastening region (3) is equipped to hold a tape-shaped strap (6) with a width of the tape-shaped strap parallel to the bearing surface (2) and wherein the loop channel (4) comprises twists such that, in bent channel areas, the width of the tape-shaped strap (6) is positioned vertical to the bearing surface (2).

13. The strapping installation according to claim 1, wherein the fastening region (3) comprises a rotating strap holding means (13, 14), by which a tape-shaped strap (6) is rotateable from a position, in which a width of the tape-shaped strap is vertical to the bearing surface (2), to a position, in which the width of the tape-shaped strap is parallel with the bearing surface (2).

14. The strapping installation according to claim 1, wherein the fastening region (3) is equipped for holding a tape-shaped strap (6) with a width of the tape-shaped strap vertical to the bearing surface (2) and for fastening the strap in this position.

15. The strapping installation according to claim 1, further comprising two or four pressing elements that are capable to be lowered (42).

16. The strapping installation according to claim 15, wherein the pressing elements (42) are knee levers (46) that are rotateable around an axis (47).

17. The strapping installation according to claim 15, wherein the pressing elements (42) comprise guide tapes (51) for guiding the strap loop (6), said guide tapes form a guide channel (55) above the strapping position, said guide channel (55) extends from the end of the loop guide (10) towards the strapping position and is open above the end of the loop guide (10).

18. The strapping installation according to claim 15, further comprising means for positioning a cover sheet (60) on the object (1) to be strapped and wherein the pressing elements (42) are equipped for displacing the cover sheet (60) while being lowered on to the object (1) to be strapped.

* * * * *